US007611149B2

(12) United States Patent
Sardella

(10) Patent No.: US 7,611,149 B2
(45) Date of Patent: Nov. 3, 2009

(54) GAME OF COMPETITIVE PHYSICAL SKILL IN ACHIEVING BALANCE

(76) Inventor: Albert Otto Sardella, Koperweg 3, 2404 LH Alphen a/d Rijn (NL)

( * ) Notice: Subject to any disclaimer, the term of this patent is extended or adjusted under 35 U.S.C. 154(b) by 486 days.

(21) Appl. No.: 11/308,591

(22) Filed: Apr. 10, 2006

(65) Prior Publication Data

US 2007/0235944 A1 Oct. 11, 2007

(51) Int. Cl.
*A63B 71/00* (2006.01)

(52) U.S. Cl. ..... 273/449; 273/451; 273/453

(58) Field of Classification Search ..... 273/440, 273/449, 451, 453, 459, DIG. 19; 482/139, 482/148, 906; 410/23, 97
See application file for complete search history.

(56) References Cited

U.S. PATENT DOCUMENTS

| | | | | | |
|---|---|---|---|---|---|
| 437,822 | A * | 10/1890 | Reach | 482/139 |
| 1,782,254 | A * | 11/1930 | Breidenbach | 273/453 |
| 2,372,967 | A * | 4/1945 | Martin | 410/97 |
| 2,937,023 | A * | 5/1960 | Seymour et al. | 482/92 |
| 3,129,940 | A * | 4/1964 | Lauro | 482/92 |
| 3,652,087 | A * | 3/1972 | Carmen | 273/453 |
| 3,718,329 | A * | 2/1973 | Sabo | 273/451 |
| 3,747,929 | A * | 7/1973 | Burke | 273/386 |
| 4,003,575 | A * | 1/1977 | Hobbs | 473/576 |
| 4,153,245 | A * | 5/1979 | McCoy | 273/451 |
| 4,346,884 | A * | 8/1982 | Warehime | 273/451 |
| 4,640,509 | A | 2/1987 | Manspeaker | |
| 4,660,828 | A | 4/1987 | Weiss | |
| 4,684,127 | A | 8/1987 | Rudell | |
| 5,087,035 | A * | 2/1992 | Podd, III | 482/51 |
| 5,152,728 | A * | 10/1992 | Podd, III | 482/51 |
| 5,318,491 | A * | 6/1994 | Houston | 482/54 |
| 5,697,133 | A * | 12/1997 | Reber et al. | 29/91 |
| 5,813,955 | A * | 9/1998 | Gutkowski et al. | 482/124 |
| 5,846,171 | A * | 12/1998 | Hollowell | 482/148 |
| 6,036,626 | A * | 3/2000 | Taylor | 482/121 |
| 6,152,427 | A * | 11/2000 | Hoslett | 254/338 |
| 6,436,019 | B1 | 8/2002 | Hollowell | |
| 6,439,149 | B1 * | 8/2002 | Hile | 114/294 |
| 6,631,539 | B1 * | 10/2003 | Chang | 24/599.4 |
| 6,663,328 | B2 * | 12/2003 | Schmidt et al. | 410/97 |
| 6,712,567 | B2 * | 3/2004 | Hsu | 410/46 |
| 6,868,586 | B1 * | 3/2005 | Hall | 24/115 A |
| 7,384,382 | B2 * | 6/2008 | Farrah et al. | 482/124 |

(Continued)

*Primary Examiner*—Raleigh W. Chiu
(74) *Attorney, Agent, or Firm*—Louis Ventre, Jr.

(57) ABSTRACT

An apparatus and means for a game of physical skill for two or more players composed of a central hub (110) capable of supporting the weight of the players; and, tethers (140). Each tether clips to the hub on one end, secures around the waist of a player and is capable of supporting the weight of that player. The game is played by at least two players who start from a standing, upright position. Each player begins by securing one end of a tether around his or her waist and clipping the other end on to the hub. Then the players simultaneously begin leaning away from the center of the hub to an off-balance slanted position supported by their tether and the counterbalancing weight of the other players. Then, all players simultaneously, thrusting their bodies forward to regain a vertical balanced position without touching, holding anyone or anything else, or being held. The game is won when the players regain their freestanding vertical position and are balanced and under their own center of gravity.

17 Claims, 3 Drawing Sheets

U.S. PATENT DOCUMENTS

2006/0138187 A1* 6/2006 Love ..... 224/572
2006/0188354 A1* 8/2006 Bosley ..... 410/23
2007/0235944 A1* 10/2007 Sardella ..... 273/449
2007/0270287 A1* 11/2007 McDonnell ..... 482/72
2008/0224412 A1* 9/2008 Newman-Bluestein ..... 273/453

* cited by examiner

GAME OF COMPETITIVE PHYSICAL SKILL IN ACHIEVING BALANCE

FIELD OF INVENTION

In the field of games employing a contest of physical skill among two or more participants, the present invention is a game of balance and re-establishing one's center of gravity in a competition performed according to definite rules.

BACKGROUND OF THE INVENTION

The invention is an entertainment game that can be played by children or adults. It is a game that can be played with two or more players. The players of the game must be physically fit and able to withstand an occasional fall to the ground. The game is designed to have at least two players tether themselves to a center hub so that they can lean back and place themselves in an erect but off-balance position, sustained by the offsetting weight of their teammate(s). The players then somewhat simultaneously attempt to return to a vertical position, standing under their own center of gravity. Teams can play against each other striving for the best time or a single team can play simply to have fun to see how fast they can restore their balance.

DESCRIPTION OF PRIOR ART

Games of balance and physical ability exist in the prior art. These typically involve pitting ones strength against one or more other individuals, such as in a game of tug-of-war. The present invention does not compete individuals against others on the basis of strength, but rather requires cooperation among the players on the basis of timing and physical agility in restoring all of the players a balanced upright position from an off-balanced condition.

representative example of prior art based on competing strength and balance is U.S. Pat. No. 6,436,019 to Roger R. Hollowell on Aug. 20, 2002. The Hollowell '019 patent discloses a competitive balance exercise game played by two participants. The game employs an elongated rod having a pair of opposite end portions and a middle portion disposed between and integrally connected with the opposite end portions, and a pair of gripping sleeves each disposed over and attached to one of the opposite end portions of the rod. The object of the game is for each participant to attempt to knock the other off balance by pushing and pulling on the elongated rod and thrusting the elongated rod from side to side until one of the participants lifts a foot or removes a hand from the elongated rod.

The present invention, unlike that of the '019 invention, does not involve opposing strengths of the players and is not limited to two, but rather involves applying players' strength together and requires two or more players. Further, the present invention is distinctive in that players are required to offset themselves from their freestanding center of gravity to initiate play and cooperate in returning themselves to a vertical standing position. The '019 invention does not suggest or teach a game where players start from an off-balance position or cooperate in achieving the ends of the game.

Prior art exists where individual game participants are tethered to each other. These games typically require physical agility and retaining balance. These games do not involve starting in an off-balance position, but rather they typically involve individuals starting in a balanced position, and then are compelled to take awkward positions while maintaining their balance.

A representative example of this type of prior art is U.S. Pat. No. 4,684,127 to Elliot A. Rudell on Aug. 4, 1987. This patent teaches a game for four or more players whereby the players limbs are tethered together, and then required to perform physical movements and maintain their attached relationships one to another. The game is played by randomly selecting and sequentially giving manipulation commands to selected players which require the selected players to establish and maintain contact with a designated point of a player and by keeping the score of successfully executed commands. The present invention does not teach tethering the players together. The present invention tethers the players to a center hub, which is not disclosed or suggested in the '127 patent. Additionally, the '127 invention does not suggest starting with the players in an off-balance position or cooperating to win the game.

Accordingly, the present invention fulfills a need for an entertaining game that promotes physical skill and team playing and enhances one's balance and ability to achieve a self-sustaining center of gravity.

BRIEF SUMMARY OF THE INVENTION

The invention is an apparatus and means for a game of physical skill for two or more players. It is composed of a central hub capable of supporting the weight of the players; and, tethers wherein each such tether clips to the hub on one end, secures around the waist of a player and is capable of supporting the weight of that player.

The game is played by at least two players who start from a standing, upright position. Each player begins by securing one end of a tether around his or her waist and clipping the other end on to the hub. Then the players somewhat simultaneously begin leaning away from the center of the hub to an off-balance slanted position supported by their tether and the counterbalancing weight of the other players. Then, all players somewhat simultaneously, thrust their bodies forward to regain a vertical balanced position without intentionally touching, holding anyone or anything else, or being held. Touching is only allowed in the form of accidental touching, which is "bumping" into and off of each other. The game is won when the players regain their freestanding vertical position and are balanced and under their own center of gravity.

DETAILED DESCRIPTION OF THE INVENTION

Figure 1:
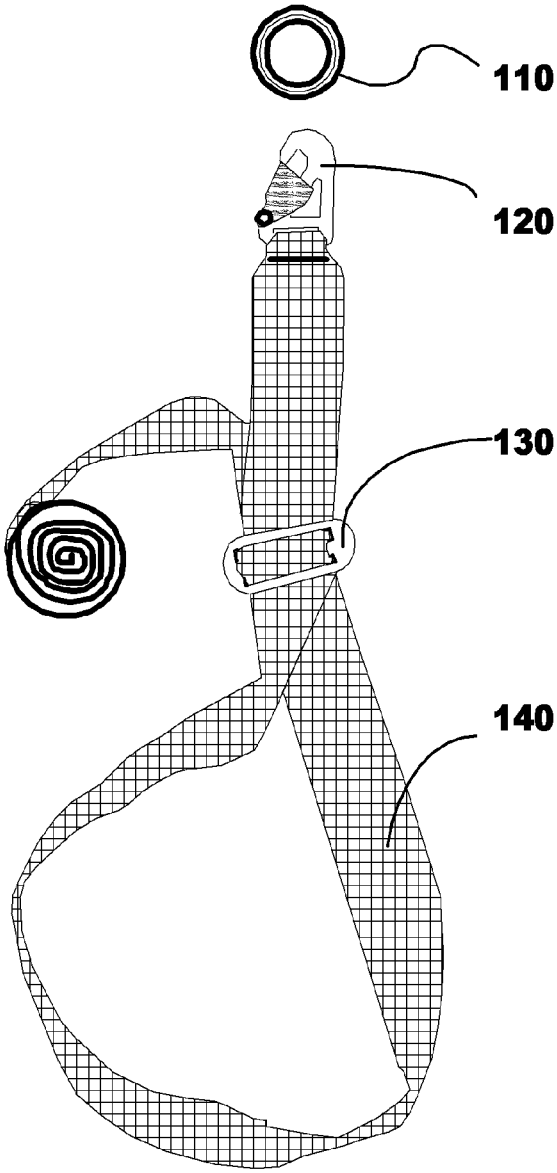
FIG. 1 is a plan view of the hub and tether in the preferred embodiment of the game.

The invention is a game of balance and center of gravity for two or more of players. The first number in the three digit reference numbers used on the drawings refers to the figure number and the last two numbers are unique for the object being identified. Referring to the drawings, the basic game comprises a hub (110) capable of supporting the weight of the players and a tether (140) that clips to the hub on one end and secures around the waist of a player at the other end. The tether must be strong enough to supporting the weight of a player.

Figure 5:
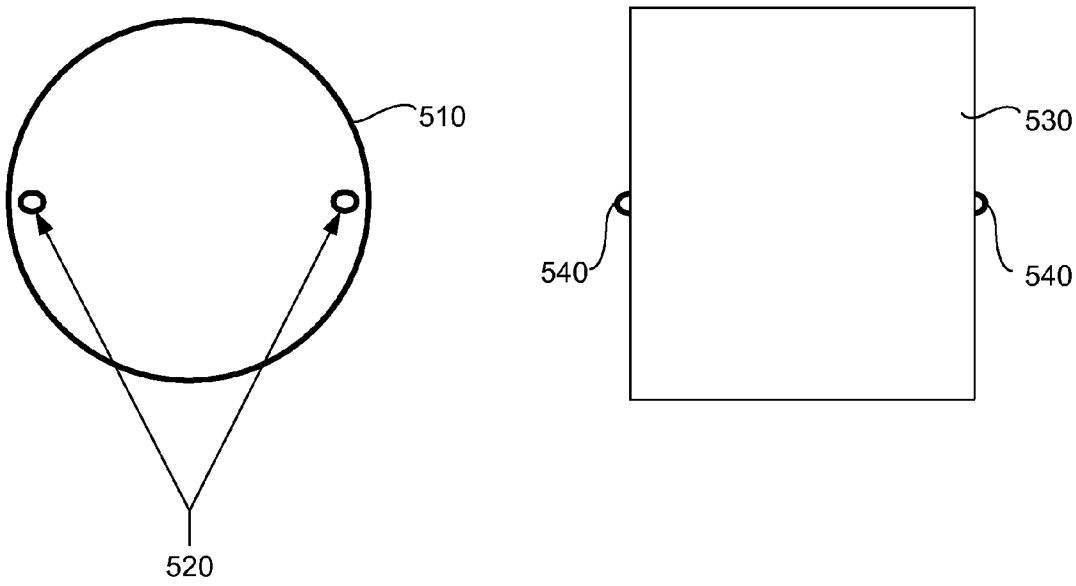
FIG. 5 is a plan view of a hub with holes and a hub with loops.

The hub (110) is typically a ring in the range of about one and one-half to three inches. For the preferred embodiment, the hub is a welded metal ring. However, a ring of any other sturdy material, such as plastic, would be acceptable. In an alternative embodiment, as shown in FIG. 5, a circular hub plate (510) is configured with holes (520) and a square hub plate (530) comprises attachment loops (540) evenly distributed around the periphery. In the case of a non-circular plate, for example, the holes or loops are evenly spaced along a circumference of a circle measured from the center of the plate. The holes (520) or loops (540) provide a means for the tether to be clipped to the plate. Even spacing along a circumference permits a uniform distribution of the forces acting on the plate during play.

The preferred embodiment of the game has tethers for 6 players. Thus, for this embodiment, the hub is capable of supporting the weight of 6 adult players. While the hub is not called upon to lift the players in normal play, the capability to support the weight of the players is easily achieved and provides a conservative margin of safety for the hub so that it will not break during play. Therefore, if an adult player's weight were conservatively estimated at 300 pounds, then in the preferred embodiment the hub would be capable of supporting the weight of about 1,800 pounds. This is easily achieved with the welded metal ring of the preferred embodiment.

For the preferred embodiment, the tether (140) is made of webbing commonly used for belts such as car seat belts, cargo control straps, truck bed tie downs, parachutes, and lifting slings. For the preferred embodiment, the belts are capable of supporting the weight of an adult player. While not called upon to lift the weight of a player during the game, the belts are required to hold an adult player at a slant and in slight acceleration towards the hub during normal play. The webbing mentioned above easily meets this preferred capability.

The tether (140) may be any length and the preferred length is in the range of about 6 to 8 feet. The length determines the distance from the hub and the players' off-balance slant that is practical during play. The preferred length provides sufficient flexibility to address the variability in the girth of players and provides some measure of varying the distance and slant of play. Excess tether can be tucked in around the waist of the player it secures.

The tether (140) secures around the waist of a player. For the preferred embodiment this is accomplished with an adjustable slide buckle (130).

The tether (140) also clips to the hub on one end. The preferred means for clipping is a safety hook (120) that locks in place and prevents accidental disengagement with the hub.

In alternative embodiments, the game is made more difficult by having the players stand on a plate (310) that is elevated from the floor and centered on a fulcrum (330), which allows the plate to travel up and down and rotate, i.e. rock up and down about a 360 degree radius. The greater the elevation from the floor the more challenging the game. Specific examples are a plate (310) situated on a fulcrum (330) that elevates the plate from the floor by 2, 4 or 6 inches. The preferred embodiment has means for stabilizing the plate to prevent its movement while the players get into the off-balance position. The means for stabilizing includes blocks (320), boards, books, or any available object, which can be placed under the plate (310) to enable the players to get into a starting position without rocking the plate (310). The means for stabilizing includes blocks, boards, books, or any available object with extraction ties to enable them to be pulled from under the plate when the game begins.

The game is played by two or more players. The process of the invention stated in particular steps, but this is for convenience in describing the invention. The invention includes variation of the order of these steps as long as the last step is the players regaining their freestanding vertical position (440) and are balanced and under their own center of gravity.

Figure 2:
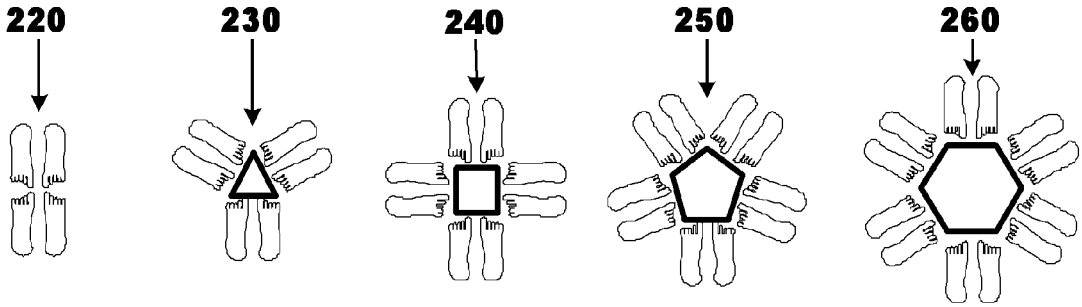
FIG. 2 shows the feet pattern for 2 through 6 players of the preferred embodiment of the game.
Figure 3:
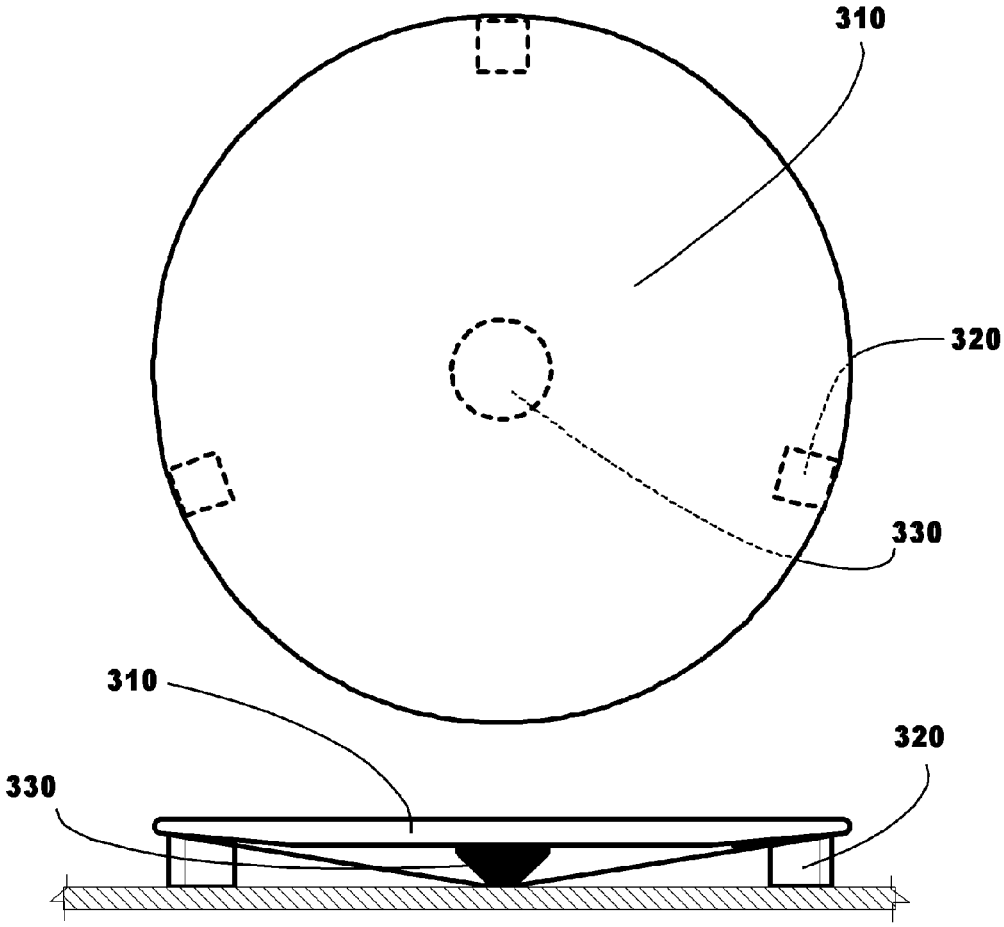
FIG. 3 shows a top and side view of the plate, fulcrum and stabilizer blocks in an advanced version of the game.
Figure 4:
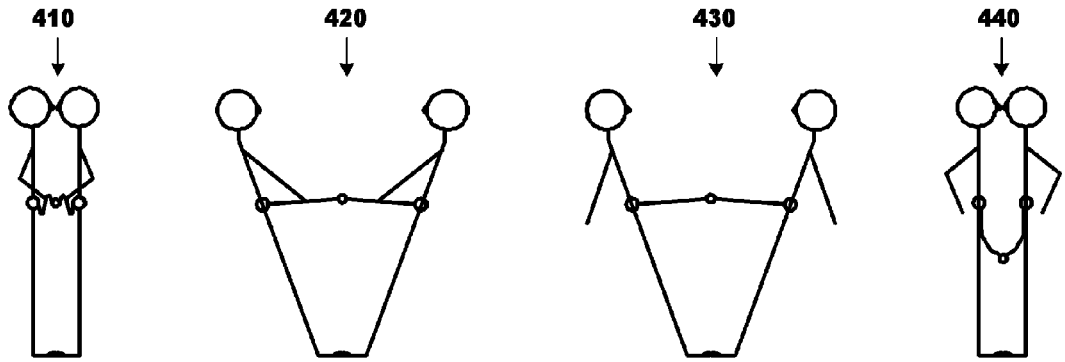
FIG. 4 is a stick figure representation of two players in the several positions of the preferred embodiment of the game.

Each player starts by securing the one end of the tether around his or her waist and clipping the other end to the hub. For the preferred embodiment, the distance between the fastened hub and the player's waist is in a range of about 4 to 24 inches. Longer lengths may be used to increase the slant of the player and the difficulty of play. Additionally, this distance will depend on the number of players because the more players, the farther they will have to stand from the hub in order to fit facing the center. Also, this distance also depends on the individual weights and heights of the players. Once tethered, FIG. 2 illustrates the standing position of the players for the examples of two (220) players, three players (230), four players (240), five players (250) and six players (260). When two players (220) are playing, they simply stand face-to-face, or toe-to-toe as shown in FIG. 4 (410). The face-to-face or toe-to-toe requirement allows "large girthed" players to stand "chest to chest" or "belly to belly" in order to initiate play. When three players (230) are playing the stand about 120 degrees apart. When four players are playing, they stand about 90 degrees from each other. When five players (250) are playing they stand about 92 degrees from each other. When six players (260) are playing, they stand about 60 degrees from each other. If more players desire to join the circle and play, the players essentially stand at an angle determined by the number of players divided into 360 degrees. For the preferred embodiment, the players, after clipping the tether to the hub, stand equidistant from each other facing the center of the hub.

In an alternative embodiment, the bottoms of the players' feet may not leave the starting position and are the only parts of the body allowed to touch the floor.

Next, the players advance to their off-balance position (420) by somewhat simultaneously holding their tethers and leaning away from the center of the hub so that each player ends up in a slanted position (430) supported by a tether and the counterbalancing weight of the other players. When more than two players are involved, they may require help into the off-balance, slanted position, for example by holding another player's hands. When the players are in a stable condition, then the active part of the game begins.

The players coordinate the simultaneous thrusting of their bodies attempting to regain a vertical balanced position without intentionally touching, holding anyone or anything else, or being held. This includes hooking with appendages or other body parts. Touching is only allowed in the form of accidental touching, which is in the nature of "bumping" into and off of each other while attempting to regain their freestanding vertical position. The game is a team effort that can be won only when each player synchronizes his or her efforts with the other players. The game is won when the players regain their freestanding vertical position (440) and are balanced and under their own center of gravity.

In the alternative embodiments employing an elevated plate (310) and fulcrum (330), the active part of the game becomes much more difficult and unpredictable because of the movement of the plate (310). The greater the elevation of the plate, the more difficult it is to win the game. The procedure for playing the game in these embodiments differs first in that the players begin either by standing on the plate with the means for stabilizing underneath the plate to prevent it from moving, or by standing on the plate being held in position with the help of others. Then, after leaning into the off-balance, slanted position, an additional step is added for the embodiments using means for stabilizing, which is a step for removing the means for stabilizing. This step frees the plate to rock up and down and swivel in 360 degrees. The thrusting step is essentially the same, but is made more challenging by the movement of the plate (310) in reaction to the thrusts.

In an alternative embodiment, the game is a race against time for players to regain their Center of Gravity, that is, their freestanding vertical position, working together as a team. In this embodiment, a referee uses a clock, a timer or stopwatch to time the players. In less than one minute, or some other mutually agreed upon time period, all participating players must return to their freestanding vertical position (440) and are balanced and under their own center of gravity. The team achieving this in the shortest amount of time is declared the winner. Any group of winning players can play against their previous winning times to improve their ranking. During the course of play in this embodiment, players are only allowed to bump into each other. Should players fall or any other body part touch the floor, the players are disqualified on that attempt, and must return to the original off-balance starting play position to start over. They may then make as many further attempts to regain their Center of Gravity as the remaining time allows.

The description above, the examples noted and the drawings are not intended to be the only embodiments of this invention and should not be construed as limiting the scope of the invention. These examples merely provide illustrations of some of the embodiments of this invention. Others will be obvious to those skilled in the art. Thus, the scope of the invention is determined by the appended claims and their legal equivalents rather than by the examples given.

What is claimed is:

1. A game of balance and center of gravity for a plurality of players comprising, (a) a hub capable of supporting the weight of the players, wherein the hub is a plate configured with a plurality of hole openings evenly spaced along a circumference of a circle measured from the center of the plate, each of said hole openings to permit a tether to be clipped to the plate therethrough; and, (b) tethers wherein each such tether clips to the hub on one end, secures around the waist of a player and is capable of supporting the weight of that player.

2. A game of balance and center of gravity for a plurality of players comprising, (a) a hub capable of supporting the weight of the players wherein the hub is a plate with a plurality of attachment loops evenly spaced along a circumference of a circle measured from the center of the plate, each of said loops to permit a tether to be clipped to the plate therethrough; and, (b) tethers wherein each such tether clips to the hub on one end, secures around the waist of a player and is capable of supporting the weight of that player.

3. The game of claim 1 wherein the hub is made of a material selected from a group consisting of plastic and metal.

4. The game of claim 1 wherein the tether is in the range of about 6 to 8 feet in length.

5. The game of claim 1 wherein the tether is made of a webbing used for belts selected from a group consisting of car seat belts, cargo control straps, truck bed tie downs, parachutes, and lifting slings.

6. The game of claim 1 wherein the mechanism to clip to the hub is a safety hook.

7. The game of claim 1 wherein the tether secures around the waist of the player using a belt with an adjustable slide buckle.

8. The game of claim 1 wherein there are 6 tethers for 6 players.

9. A process for playing the game of claim 1 comprising the steps of, (a) securing one end of a tether around the waist of each player;

(b) clipping the other end of each tether secured to a player to the hub;

(c) leaning, somewhat simultaneously by all players, away from the center of the hub, wherein each player remains in an off-balance slanted position supported by a tether and the counterbalancing weight of the other players; and (d) thrusting, all players somewhat simultaneously, their bodies to regain a vertical balanced position without intentionally touching, holding anyone or anything else, or being held, wherein the game is won when the players regain their freestanding vertical position and are balanced and under their own center of gravity.

10. The process of claim 9 wherein after leaning away from the center of the hub, the distance between the hub and the player's waist is in a range of about 4 to 24 inches.

11. The process of claim 9 wherein the game is a race against time and the players must regain their freestanding vertical position and are balanced and under their own center of gravity in a mutually agreed upon time period, provided that the players are required to start over if time remains in the period and any player falls or any body part other than the bottoms of players' feet touch the floor.

12. The process of claim 9 wherein during the step of thrusting, the bottoms of players' feet may not leave the starting position and are the only parts of the players bodies allowed to touch the floor.

13. The process of claim 9 wherein after clipping the tether to the hub each player stands equidistant from each other facing the center of the hub.

14. The game of claim 1 further comprising, (a) a plate upon which the players stand;

(b) a fulcrum at the bottom center of the plate to elevate the plate from the floor and allow the plate to rock up and down in any 360° radius; and (c) means for stabilizing the players on the plate.

15. The game of claim 14 wherein the elevation of the plate is selected from a group consisting of 2 inches, 4 inches and 6 inches.

16. A process for playing the game of claim 14 comprising the steps of, (a) standing on the plate with the means for stabilizing underneath the plate;

(b) securing one end of a tether around the waist of each player;

(c) clipping the other end of each tether secured to a player to the hub;

(d) leaning, somewhat simultaneously by all players, away from the center of the hub, wherein each player remains in an off-balance slanted position supported by a tether, the plate, and the counterbalancing weight of the other players;

(e) removing the means for stabilizing; and (f) thrusting, all players somewhat simultaneously, their bodies forward to regain a vertical balanced position without intentionally touching, holding anyone or anything else, or being held, wherein the game is won when the players regain their freestanding vertical position and are balanced and under their own center of gravity.

17. A process for playing the game of claim 14 comprising the steps of, (a) standing on the plate being held in position with the help of others;

(b) securing one end of a tether around the waist of each player;

(c) clipping the other end of each tether secured to a player to the hub;

(d) leaning, somewhat simultaneously by all players, away from the center of the hub, wherein each player remains in an off-balance slanted position supported by a tether, the plate, and the counterbalancing weight of the other players; and (e) thrusting, all players somewhat simultaneously, their bodies forward to regain a vertical balanced position without intentionally touching, holding anyone or anything else, or being held, wherein the game is won when the players regain their freestanding vertical position and are balanced and under their own center of gravity.

* * * * *